US007894730B2

(12) United States Patent
Okano et al.

(10) Patent No.: US 7,894,730 B2
(45) Date of Patent: Feb. 22, 2011

(54) IMAGE FORMING APPARATUS HAVING CONTAINING UNIT CONTAINING WASTE

(75) Inventors: Tetsuya Okano, Anjo (JP); Eiji Kawahara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 577 days.

(21) Appl. No.: 11/966,362

(22) Filed: Dec. 28, 2007

(65) Prior Publication Data

US 2008/0159760 A1 Jul. 3, 2008

(30) Foreign Application Priority Data

Dec. 28, 2006 (JP) ..... 2006-354143

(51) Int. Cl.
*G03G 21/12* (2006.01)

(52) U.S. Cl. ..... 399/35

(58) Field of Classification Search ..... 399/9, 399/33, 34, 120, 360
See application file for complete search history.

(56) References Cited

U.S. PATENT DOCUMENTS 5,909,604 A * 6/1999 Arai ..... 399/35
2005/0220465 A1 10/2005 Yamaoka et al.

FOREIGN PATENT DOCUMENTS

| | | |
|---|---|---|
| JP | 06-202529 | 7/1994 |
| JP | 10-260618 | 9/1998 |
| JP | 11-038850 | 2/1999 |
| JP | 2002-139971 | 5/2002 |
| JP | 2004-151380 | 5/2004 |
| JP | 2005-284012 | 10/2005 |

OTHER PUBLICATIONS

Japanese Office Action, Dated Jul. 29, 2008, Application No. 2006-354143.

* cited by examiner

*Primary Examiner*—David M Gray
*Assistant Examiner*—Gregory H Curran
(74) *Attorney, Agent, or Firm*—Banner & Witcoff, Ltd

(57) ABSTRACT

An image forming apparatus includes: an image forming unit; a containing unit; two detecting units; a counting unit; and a determining unit. The image forming unit is configured to form a toner image. The containing unit is configured to contain waste that is generated when the image forming unit forms a toner image. The two detecting units that are configured to detect the waste accumulated in the containing unit. The counting unit starts, when at least one of the two detecting units detects waste, counting up a count value based on the toner image forming operation executed by the image forming unit. The determining unit determines that waste accumulated in the containing unit has reached a maximum amount if the count value of the counting unit is equal to or greater than a predetermined first threshold value and both of the two detecting units detects waste.

15 Claims, 11 Drawing Sheets

IMAGE FORMING APPARATUS HAVING CONTAINING UNIT CONTAINING WASTE

CROSS REFERENCE TO RELATED APPLICATION

This application claims priority from Japanese Patent Application No. 2006-354143 filed Dec. 28, 2006. The entire content of this priority application is incorporated herein by reference.

TECHNICAL FIELD

The present invention relates to an image forming apparatus.

BACKGROUND

Japanese Patent Application Laid-Open Publication No. 6-202529A has proposed an image forming apparatus which is configured that waste such as residual toner and paper dust is generated as a result of a toner image forming operation and is recovered into a container. To recover waste into the container, a cleaning device is used in the image forming apparatus. The image forming apparatus employs two detecting members (a first detecting member and a second detecting member), each for detecting whether the amount of waste accumulated in the container has reached a corresponding amount.

According to this proposal, before the container is filled up with waste, the first detecting member detects waste, and the image forming apparatus informs a user that the container should soon be replaced by an empty one.

When the container is filled up with waste, the second detecting member detects waste in the container. At this time, the image forming apparatus informs the user that the container has to be replaced with an empty one immediately, and stops operating. This prevents waste from overflowing the container.

SUMMARY

Waste may possibly accumulate in a part of the container, being heaped high in the part of the container. In this case, the second detecting member will inevitably detect waste, though the container has not yet been filled so much.

The user may remove the container from the image forming apparatus, and then insert the container back into the apparatus. When the user thus removes or inserts the container, waste may accumulate in a part of the container or may be evenly distributed in the container. Due to these changes of the accumulated state of waste, the second detecting member may possibly detect waste.

When the second detecting member detects waste, the user will be informed that the container has to be replaced by an empty one or the image forming apparatus will automatically stop operating. Consequently, the user needs to replace the container with an empty one or to remove waste from the container despite the fact that the container still has room for waste.

The longer the cleaning device is used, the lower the waste-recovering ability of the cleaning device will be and the cleaning device will finally become no longer be able to operate.

In view of the above, one object of this invention is to provide an image forming apparatus that can determine at an appropriate timing that waste recovered has filled up the container.

Another object of this invention is to provide an image forming apparatus that can prompt a user to replace the cleaning device with a new one at an appropriate timing.

In order to attain the above and other objects, the present invention provides an image forming apparatus including: an image forming unit; a containing unit; two detecting units; a counting unit; and a determining unit. The image forming unit is configured to form a toner image. The containing unit is configured to contain waste that is generated when the image forming unit forms a toner image. The two detecting units that are configured to detect the waste accumulated in the containing unit. The counting unit starts, when at least one of the two detecting units detects waste, counting up a count value based on the toner image forming operation executed by the image forming unit. The determining unit determines that waste accumulated in the containing unit has reached a maximum amount if the count value of the counting unit is equal to or greater than a predetermined first threshold value and both of the two detecting units detects waste.

According to another aspect, the present invention provides an image forming apparatus including: a housing; an image forming unit; a cleaning unit; a containing unit; a detecting unit; and a notifying unit. The image forming unit is mounted in the housing and that is configured to form a toner image. The cleaning unit recovers waste generated when the image forming unit forms a toner image. The containing unit contains the waste recovered by the cleaning unit, the cleaning unit being removably mounted in the housing together with the containing unit. The detecting unit detects waste contained in the containing unit. The notifying unit notifies that the containing unit should be replaced when the detecting unit detects waste.

According to another aspect, the present invention provides an image forming apparatus including: an image forming unit; a containing unit; first and second detecting units; a counting unit; and a determining unit. The image forming unit is configured to form a toner image. The containing unit is configured to contain waste that is generated when the image forming unit forms a toner image. The first and second detecting units are configured to detect the waste accumulated in the containing unit. The counting unit starts, when the first detecting unit detects waste, counting up a count value based on the toner image forming operation executed by the image forming unit. The determining unit determines that waste accumulated in the containing unit has reached a maximum amount if the count of the counting unit is equal to or greater than a predetermined first threshold value and the second detecting unit detects waste.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
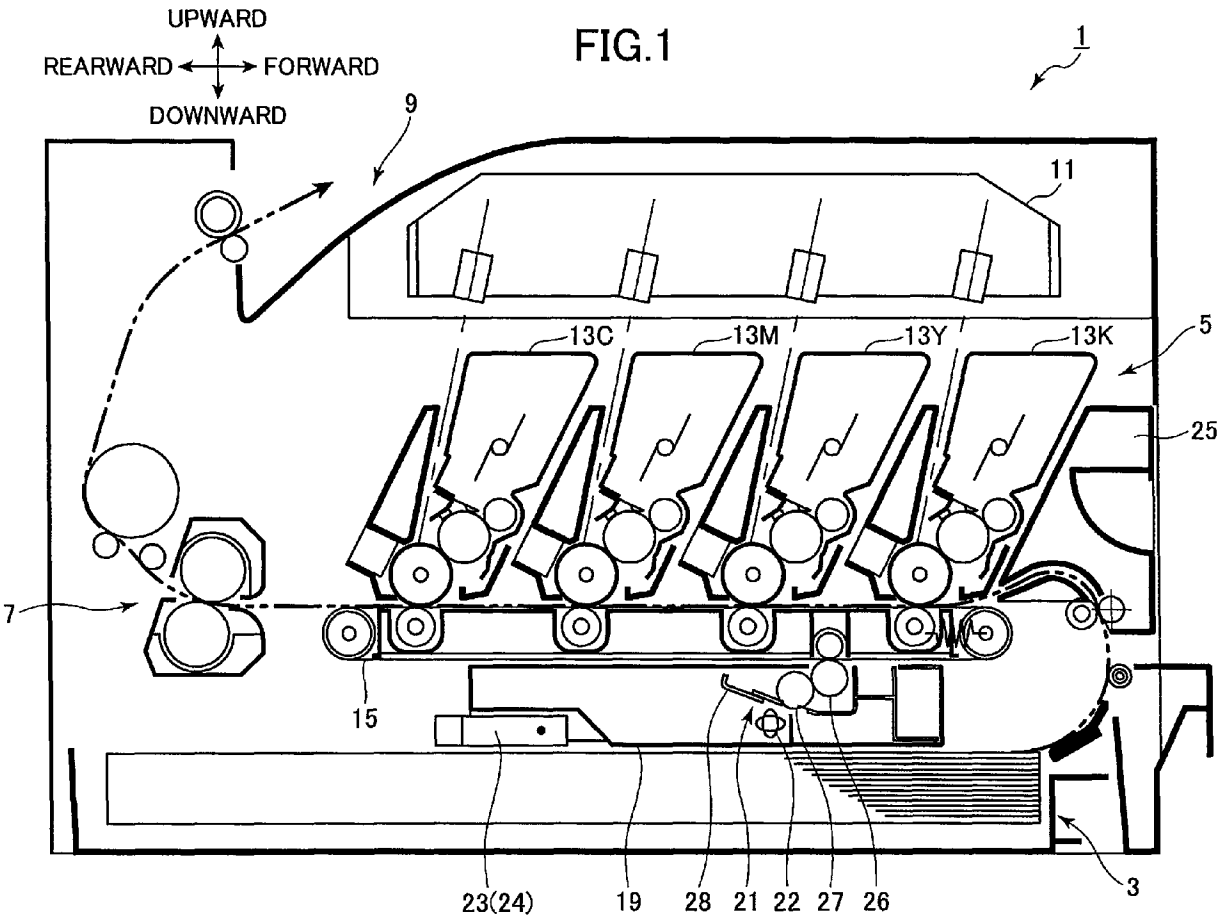
FIG. 1 is a sectional view showing the schematic structure of an image forming apparatus according to an embodiment of this invention.

An image forming apparatus according to an embodiment of the invention will be described while referring to the accompanying drawings wherein like parts and components are designated by the same reference numerals to avoid duplicating description.

FIG. 1 is a sectional view showing the schematic structure of an image forming apparatus 1 according to the present embodiment.

The image forming apparatus 1 is a laser printer that is designed to form images on recording media such as paper sheets by means of electrophotography method. The image forming apparatus 1 includes a sheet supplying unit 3, an image forming unit 5, a fixing unit 7, and a sheet discharging unit 9.

The sheet supplying unit 3 supplies a recording medium such as a paper sheet. The recording medium supplied from the sheet supplying unit 3 is transported to the image forming unit 5. The image forming unit 5 is for printing a multicolor image on the recording medium, and includes a laser scanner 11, toner cartridges 13K, 13Y, 13M and 13C, and a conveyor belt 15.

In the image forming unit 5, the laser scanner 11 forms four electrostatic latent images. The electrostatic latent images are developed with toner supplied from the toner cartridges 13K, 13Y, 13M and 13C, respectively, forming four toner images. The developed toner images are transferred to a single recording medium transported by the conveyor belt 15, thereby forming a multi-color image.

The fixing unit 7 has a pair of rollers. While a recording medium is passing through the nip between the rollers, heat and pressure is applied to the recording medium, thereby thermally fixing the multi-color toner image on the recording medium. The sheet discharging unit 9 discharges the recording medium sent from the fixing unit 7.

A waste box 19 is provided below the conveyor belt 15. The waste box 19 is for containing waste including residual toner and paper dust. The residual toner and the paper dust are generated in the process of forming the toner images on recording medium by the image forming unit 5.

In the waste box 19, a cleaning mechanism 21 and an elliptical rotor 22 are provided. The cleaning mechanism 21 is for recovering waste from the conveyor belt 15. The elliptical rotor 22 rotates to feed the waste recovered by the cleaning mechanism 21, to the rear part of the waste box 19.

The cleaning mechanism 21 includes a cleaning roller 26, a cleaning shaft 27, and a blade 28.

The cleaning roller 26 is provided in contact with the conveyor belt 15. The cleaning roller 26 rotates in a direction opposite to the direction (counterclockwise in FIG. 1), in which the conveyor belt 15 is driven to rotate. While so rotating, the cleaning roller 26 recovers waste from the conveyor belt 15.

The cleaning shaft 27 is provided in contact with the cleaning roller 26 and is electrically charged in a polarity opposite to the polarity of the electric charge of the waste. The cleaning shaft 27 electrically attracts the waste thereto, recovering the same from the cleaning roller 26.

The blade 28 is provided in direct contact with the clearing shaft 27. The blade 28 is for scraping the waste off the cleaning shaft 27.

As described above, the cleaning mechanism 21 recovers the waste into the waste box 19.

The elliptical rotor 22 has an elliptical cross section. The rotor 22 rotates around an axis that extends perpendicular to the elliptical cross section. As the elliptical rotor 22 rotates, the elliptical rotor 22 moves the waste scraped by the blade 28, to the rear part of the waste box 19.

Figure 3:
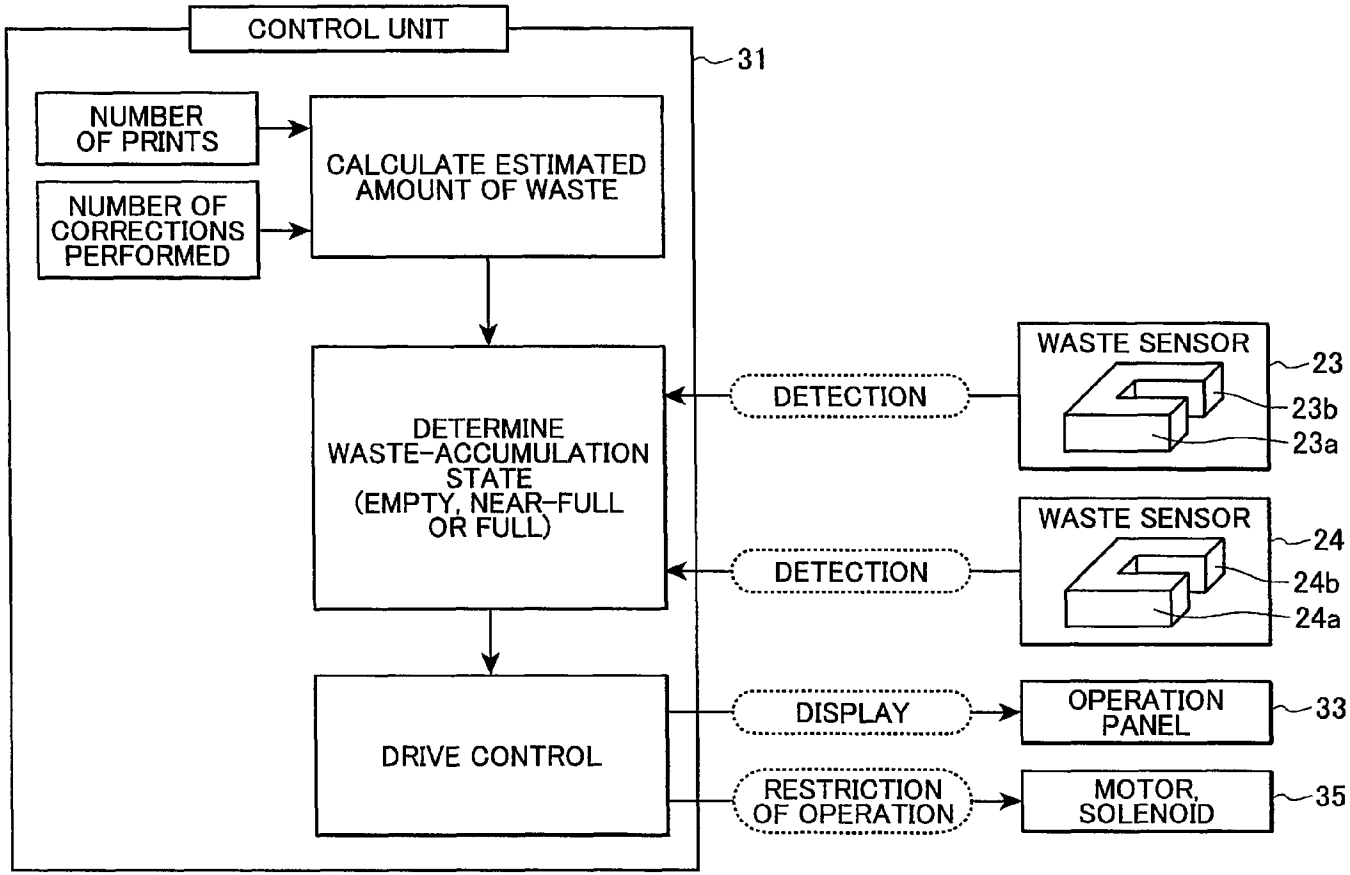
FIG. 3 is a block diagram depicting the control system incorporated in the image forming apparatus.

Waste sensors 23 and 24 are provided inside the waste box 19, at its lower rear end portions. The waste sensors 23 and 24 are photointerrupters. The waste sensor 23 includes a light-emitting part 23*a* and a light-receiving part 23*b* as shown in FIG. 3. The waste sensor 24 includes a light-emitting part 24*a* and a light-receiving part 24*b* as shown in FIG. 3. The waste sensors 23 and 24 have the same configuration, and are arranged side by side in the left-to-right direction, for example, in the waste box 19.

If the waste accumulates in the waste box 19 at a location between the light-emitting part 23*a* and the light-receiving part 23*b*, the waste intercepts the light beam transmitted from the light-emitting part 23*a* to the light-receiving part 23*b* of the waste sensor 23. As a result, the waste sensor 23 detects the waste. If the waste accumulates in the waste box 19 at a location between the light-emitting part 24*a* and the light-receiving part 24*b*, the waste intercepts the light beam transmitted from the light-emitting part 24*a* to the light-receiving part 24*b* of the waste sensor 24. As a result, the waste sensor 24 detects the waste.

Figure 2:
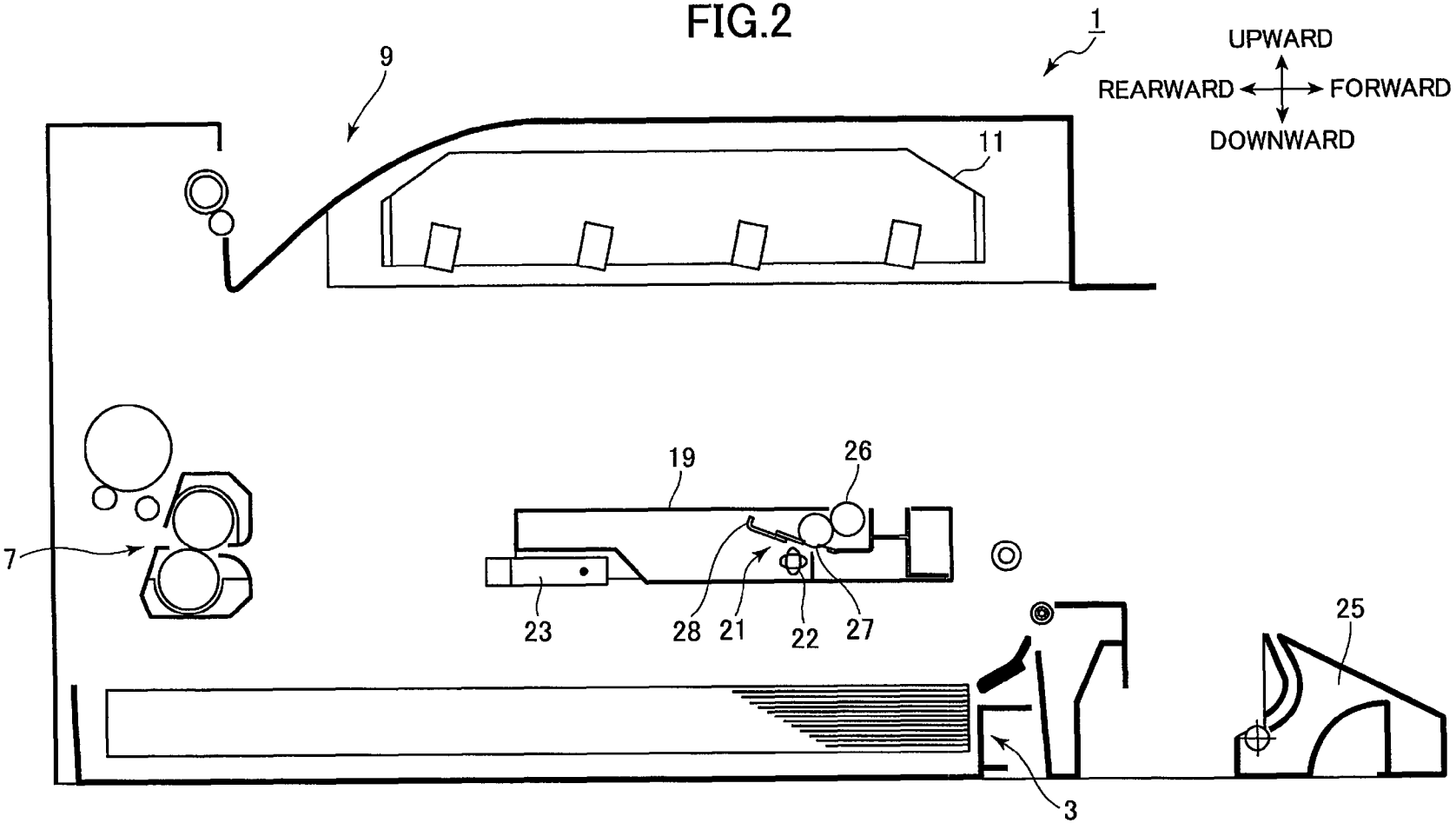
FIG. 2 is a sectional view showing the image forming apparatus with the waste box being removed from the apparatus.

As shown in FIG. 2, the waste box 19 can be removed from the housing of the image forming apparatus 1. An opening/closing part 25 is provided in the front part of the image forming apparatus 1. Once the opening/closing part 25 is opened, the waste box 19 can be replaced by a new one.

More specifically, the image forming unit 5 is first pulled out of the housing in the horizontal direction. Next, the conveyor belt 15 is pulled out forwards. Then, the waste box 19 is removed from the housing of the image forming apparatus 1. Because the cleaning mechanism 21 and the elliptical rotor 22 are both provided in the waste box 19, the cleaning mechanism 21 and the elliptical rotor 22 are removed from the housing of the image forming apparatus 1 together with the waste box 19. Then, the waste box 19 is replaced with a new one. Thus, the waste box 19 having the cleaning mechanism 21 and the elliptical rotor 22 therein is replaced with a new one that has a new cleaning mechanism 21 and a new elliptical rotor 22.

The longer the cleaning mechanism 21 is used, the lower the waste-recovering ability of the cleaning mechanism 21 will be and the cleaning mechanism 21 will finally become no longer be able to operate.

The waste box 19 and the cleaning mechanism 21 are designed that the length of a period from when the waste box 19 is newly mounted in the image forming apparatus 1 until the waste box 19 is filled with waste is equal to or a little shorter than the length of a period from when the cleaning mechanism 21 is newly mounted in the image forming apparatus 1 together with the waste box 19 until the cleaning mechanism 21 can no longer recover waste from the conveyor belt 15 due to deterioration of the performance of the cleaning mechanism 21.

The control system incorporated in the image forming apparatus 1 will be described below with reference to FIG. 3. FIG. 3 is a block diagram of the control system incorporated in the image forming apparatus 1.

The image forming apparatus 1 includes a control unit 31 that controls the entire part of the image forming apparatus 1.

A main component of the control unit 31 is a microcomputer of a known type. To the control unit 31, the waste sensors 23 and 24 are connected. In addition, a motor and a solenoid 35 that are incorporated in the image forming apparatus 1 and an operation panel 33 are connected to the control unit 31. These components are controlled by control signals supplied from the control unit 31.

The control unit 31 has a nonvolatile memory (e.g., ROM). The nonvolatile memory stores therein various control programs. In accordance with the control programs, a CPU (not shown) provided in the control unit 31 performs various controls.

More specifically, in this embodiment, the control unit 31 calculates an estimated amount of recovered waste based on: the number of sheets printed and the number of corrections executed. The estimated amount of recovered waste is a numerical value that represents the amount of waste that is assumed to be recovered in the waste box 19. The numerical value reflects not only the amount of residual toner but also the amount of paper dust.

The control unit 31 determines a waste-accumulation state, in which the waste is accumulated in the waste box 19, based on the estimated amount of recovered waste and on the detection signals supplied from the waste sensors 23 and 24. The waste-accumulation state is "empty," "near-full" or "full."

The empty state indicates that the waste box 19 still has large room for waste. The near-full state indicates that the waste box 19 has small room for waste. The full state indicates that the waste box 19 has been filled up, having no room for waste.

In accordance with the determined waste-accumulation state, the control unit 31 displays an alarm or an error message on the operation panel 33, and restricts the operation of the motor and the solenoid 35. These processes will be described later in detail.

Next will be described, with reference to FIG. 4(*a*)-4(*c*), how the image forming apparatus 1 determines the waste-accumulation state.

The control unit 31 determines that the waste box 19 is "near-full" when the box 19 is almost full of waste. When the waste box 19 is filled up with waste, the control unit 31 determines that the waste box 19 is "full." The control unit 31 determines that the waste-accumulation state is changed from "empty" through "near-full" to "full," in either one of three different time sequences shown in FIGS. 4(*a*), 4(*b*) and 4(*c*).

More specifically, in each time sequence, first, waste is detected by no waste sensors 23, 24. When either the sensor 23 or 24 detects waste (timing t1), the waste box 19 is determined to be "near-full", and the operation panel 33 displays an alarm indicating that the waste box 19 should be soon replaced with a new one. Simultaneously, a process of incrementing the estimated amount of waste is started. The estimated amount of waste can be decremented in some cases, as will be described later.

The estimated amount of waste is incremented or decremented by one of three preset values every time the image forming unit 5 performs a toner image forming operation. More specifically, the estimated amount of waste is incremented or decremented by a first preset value every time the image forming unit 5 performs ordinary printing operation, by a second preset value every time the image forming unit 5 performs registration error correction operation, and by a third preset value every time the image forming unit 5 performs density correction operation.

The estimated amount of waste is incremented several times after the waste box 19 is determined to be "near-full," before the waste box 19 is finally determined to be "full."

Figure 4A:
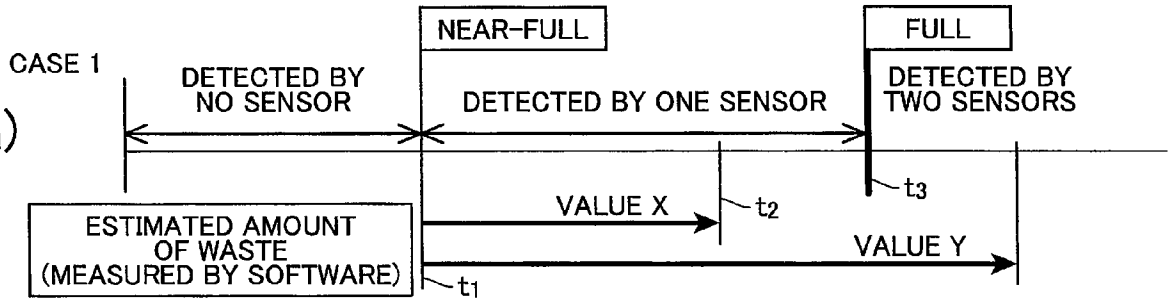
FIGS. 4(*a*) to 4(*c*) are timing charts, illustrating three different sequences of determining a near-full state and a full state of the waste box.
Figure 4B:
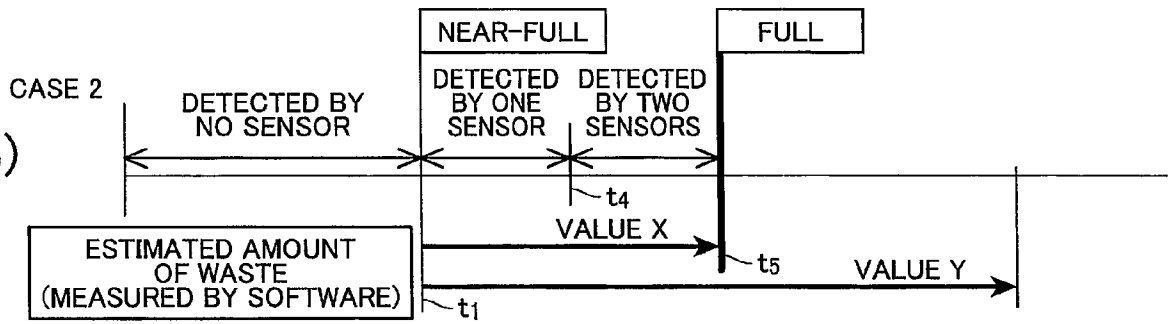
Figure 4C:
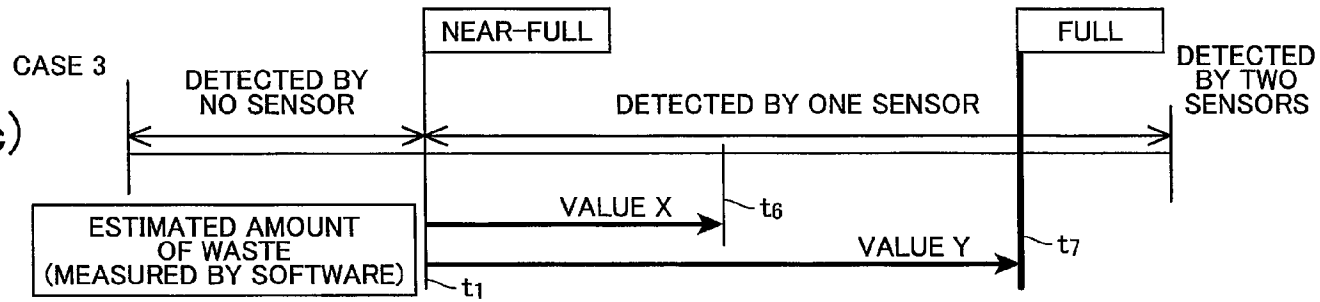

The timings when the accumulation state of the waste box is changed from "near-full" to "full" are different from one another in the time sequences shown in FIGS. 4(*a*), 4(*b*) and 4(*c*).

In the time sequence 1 shown in FIG. 4(*a*), the estimated amount of waste is repeatedly incremented, reaching a minimum printing guaranteed value X (timing t2), before the other waste sensor detects waste. At this timing, however, the waste box 19 is not determined to be "full."

It is noted that the minimum printing guaranteed value X has been preset to such a value that the waste box 19 is never filled up before the estimated amount of waste reaches the value X.

So, even though the estimated amount of waste has reached the minimum printing guaranteed value X, the waste box 19 is considered to have room for waste because the other waste sensor has not detected waste.

Thereafter, as the waste is further recovered into the waste box 19, the other waste sensor detects waste (timing t3). At this time, the waste box 19 is determined to be "full." That is, it is determined that the amount of waste accumulated in the waste box 19 has reached a maximum amount that the waste box 19 can store therein. The operation panel 33 displays an alarm indicating that the waste box 19 should be now replaced with a new one. The motor and the solenoid 35 are brought into an inoperable state until the waste box 19 is replaced with a new one. Thus, the image forming unit 5 is prohibited from operating.

In the time sequence 2 shown in FIG. 4(*b*), the other waste sensor detects waste (timing t4). At this time, the estimated amount of waste has not reached the minimum printing guaranteed value X. So, the waste box 19 is not determined to be "full."

That is, the waste box 19 is considered to have room for waste unless the estimated amount of waste has reached the minimum printing guaranteed value X. The other sensor is considered to detect waste because waste accumulates unevenly in the waste box 19.

Thereafter, as waste is further recovered into the waste box 19, the estimated amount of waste reaches the minimum printing guaranteed value X (timing t5). At this timing, the waste box 19 is determined to be "full." An alarm is displayed and the image forming unit 5 is prohibited from operating in the same manner as in the time sequence 1 shown in FIG. 4(*a*).

In the time sequence 3 shown in FIG. 4(*c*), while the other sensor has not detected waste, the estimated amount of waste reaches the minimum printing guaranteed value X (timing t6). At this time, the waste box 19 is not determined to be "full," as in the time sequence 1.

Thereafter, while the other waste sensor has not yet detected waste, the estimated amount of waste reaches a maximum estimated value Y (timing t7). At this time, the waste box 19 is determined to be "full." Thus, in the time sequence 3, the box 19 is determined to be "full" even though the other sensor has not yet detected waste.

It is noted that the maximum estimated value Y has been preset to such a value that when the estimated amount of waste reaches the maximum estimated value Y, the waste box 19 is probably filled up, even if one of the sensors 23 and 24 has not yet detected waste. The maximum estimated value Y is greater than the minimum printing guaranteed value X.

So, because the estimated amount of waste has reached the maximum estimated value Y, it is estimated that the waste box 19 is already filled up with waste and the other sensor may have possibly failed to detect waste due to some troubles developed in the other sensor. An alarm is displayed and the image forming unit 5 is prohibited from operating, in the same manner as in the time sequences 1 and 2.

Next will be described with reference to the flowcharts of FIGS. 5 to 13 how the image forming apparatus 1 operates in order to determine the waste-accumulation state.

The image forming apparatus 1 performs an initializing process when the power switch of the image forming apparatus 1 is turned on.

Figure 5:
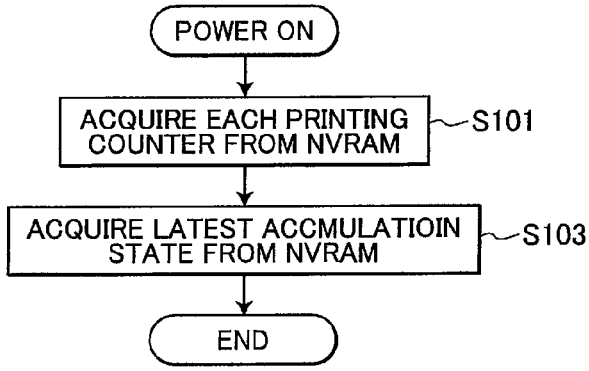
FIG. 5 is a flowchart showing the process of initializing the image forming apparatus.

The initializing process will be described below with reference to FIG. 5.

It is noted that although not shown in FIG. 3, a RAM and an NVRAM are provided in the control unit 31. The NVRAM is a nonvolatile memory. The control unit 31 also has an ordinary printing counter, a registration-error-correction printing counter, and a density-correction printing counter. The NVRAM stores therein values counted by the ordinary printing counter, the registration-error-correction printing counter, and the density-correction printing counter.

When the power switch is turned on, the control unit 31 acquires, from the NVRAM, values counted by the ordinary printing counter, the registration-error-correction printing counter, and the density-correction printing counter (S101).

The ordinary printing counter is for counting up or down by one every time the image forming unit 5 performs an ordinary printing on one sheet of recording medium. The image forming unit 5 performs the ordinary printing on one sheet of recording medium by forming toner images on the one sheet of recording medium according to print data.

The registration-error-correction printing counter is for counting up or down by one every time the image forming unit 5 performs a registration-error-correction printing. The image forming unit 5 performs the registration-error-correction printing by forming toner images of cyan, magenta, yellow, and black on the conveyor belt 15. Positions of the respective toner images relative to one another are detected by a density detector (not shown) provided in the image forming apparatus 1, and registration errors between the respective toner images are determined. The control unit 31 will control the image forming unit 5 to compensate for the determined registration errors when the image forming unit 5 performs an ordinary printing operation.

The density-correction printing counter is for counting up or down by one every time the image forming unit 5 performs a density-correction printing. The image forming unit 5 performs the density-correction printing by forming toner images of colors of cyan, magenta, yellow, and black on the conveyor belt 15. Densities of the respective toner images are detected by the density detector. The control unit 31 will control the image forming unit 5 based on the detected densities to correct densities of the toner images when the image forming unit 5 performs an ordinary printing operation.

It is noted that the counts acquired in S101 are values that have been finally acquired in the respective counters during the latest-executed toner-image-forming processes (ordinary printing process, registration-error-correction printing process, and density-correction printing process). These counts are used as initial values for the presently-being executed operation of the apparatus 1. Thus, the counts that have been cumulated in the respective counters up to the present are utilized in the presently-being executed operation.

Next, in S103, the control unit 31 acquires, from the NVRAM, data indicative of the waste-accumulation state of the waste box 19 that has been determined and stored in the latest-executed operation (S207 (FIG. 6) or S717 (FIG. 11) as will be described later). The thus acquired waste-accumulation state is either one of two states: "empty" and "full." Upon completion of S103, the initializing process ends.

The image forming apparatus 1 performs a warming-up process when the power switch of the apparatus 1 is turned on. That is, the image forming apparatus 1 performs the warming-up process after performing the initializing process of FIG. 5. The image forming apparatus 1 performs the warming-up process also when the image forming apparatus 1 receives input of data or receives input of an instruction from the operation panel 33 while the image forming apparatus 1 is temporarily in a sleeping state.

The warming-up process will be described with reference to FIG. 6.

When the warming-up operation is started, the control unit 31 first performs a cleaning process (S201). In the cleaning process, the cleaning mechanism 21 operates to clean the conveyor belt 15.

Next, the control unit 31 controls the waste sensors 23 and 24 to perform detection processes (S203).

Figure 7:
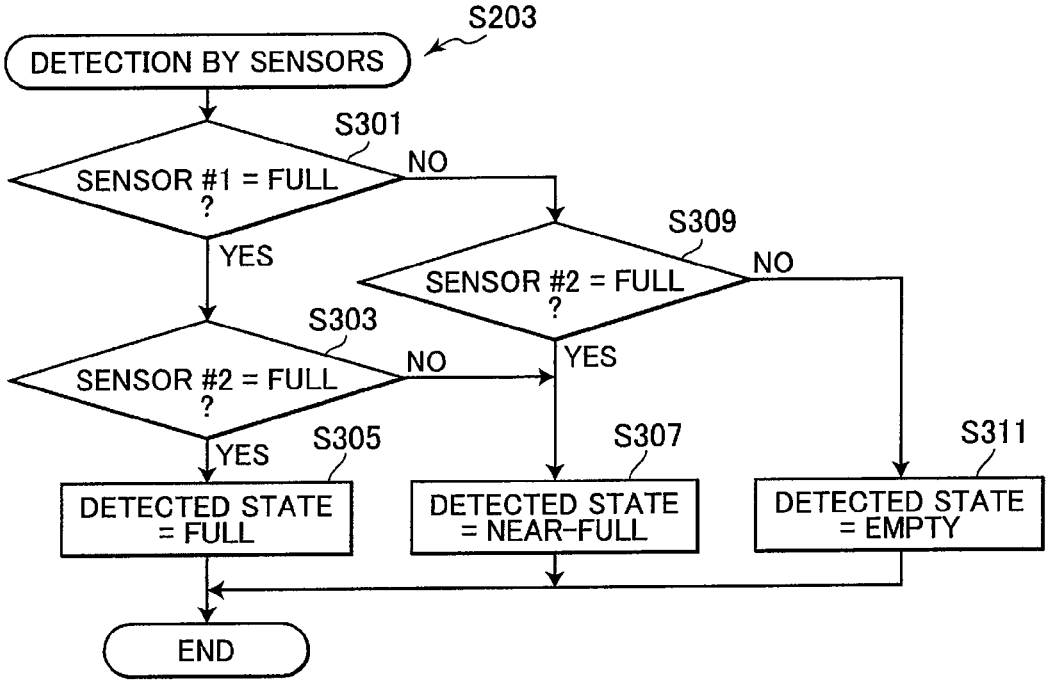
FIG. 7 is a flowchart showing the process of detecting the state of the waste box by using sensors.

The detection process of S203 is shown in FIG. 7. Because the waste sensors 23 and 24 can be used interchangeably, one of the two sensors 23 and 24 will be referred to as sensor #1, and the other will be referred to as sensor #2 hereinafter.

As shown in FIG. 7, in the detection process of S203, the control unit 31 first determines whether sensor #1 has detected waste, in other words, whether sensor #1 has detected "full state" (S301). If sensor #1 has detected the "full state" (YES in S301), the control unit 31 determines whether sensor #2 has detected waste, in other words, whether sensor #2 has detected "full state" (S303).

If sensor #2 has detected "full state" (YES in S303), the detected state is set to "full" and the detected state "full" is stored in the RAM (S305). The process of FIG. 7 is then terminated.

If sensor #2 is not determined to have detected "full state" in S303 (NO in S303), the detected state is set to "near-full" and the detected state "near-full" is stored in the RAM (S307). Then, the process of FIG. 7 is terminated.

If sensor #1 has not detected "full state" (NO in S301), the control unit 31 determines whether sensor #2 has detected waste, that is, whether sensor #2 has detected "full state" (S309).

If the sensor #2 has detected "full state" (YES in S309), the detected state is set to "near-full" and the detected state "near-full" is stored in the RAM (S307). The process of FIG. 7 is then terminated. If the sensor #2 has not detected "full state" (NO in S309), the detected state is set to "empty" and the detected state "empty" is stored in the RAM (S311). Then, the process of FIG. 7 is terminated.

Thus, when the process of FIG. 7 is completed, the detected state is set to "full," "near-full" or "empty."

Note that the waste-accumulation state will be determined in S207 (FIG. 6) based on data of states "full," "near-full" or "empty" detected in S305, S307 or S311.

Figure 6:
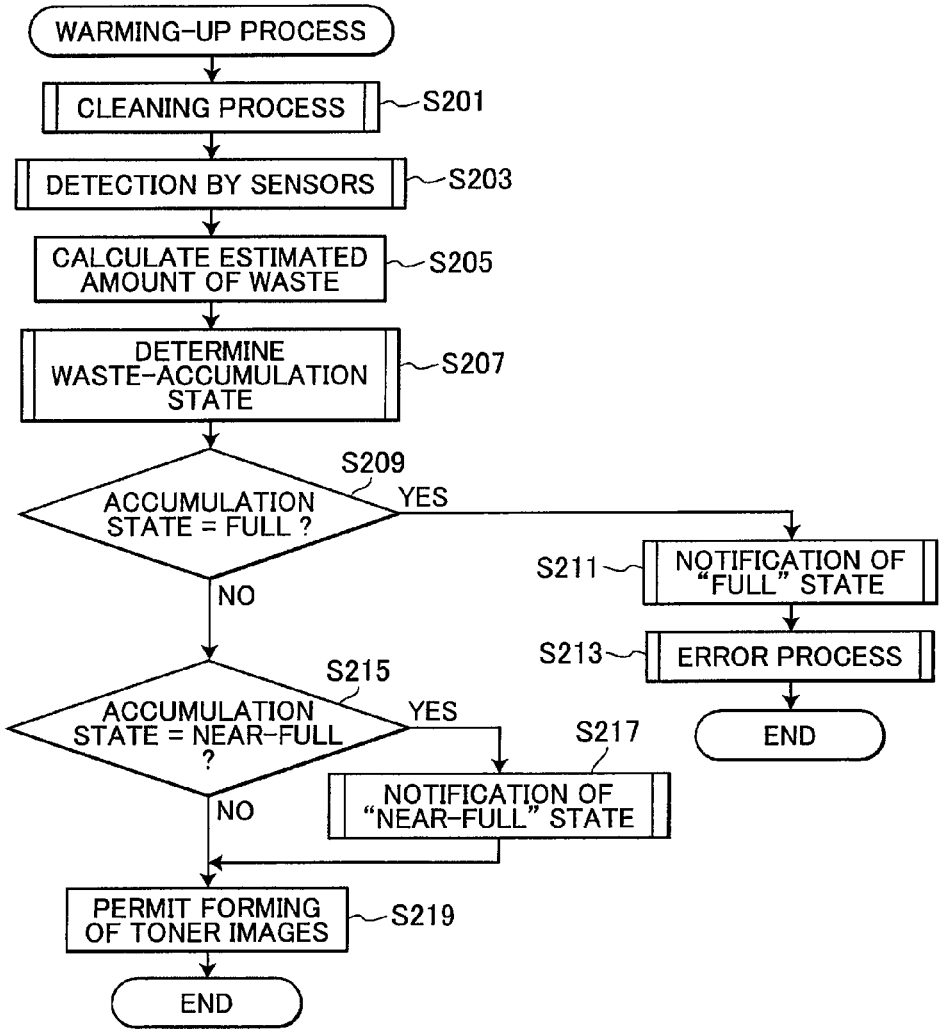
FIG. 6 is a flowchart showing the process of warming up the image forming apparatus.

As shown in FIG. 6, after performing S203, the control unit 31 starts performing the process of calculating the estimated amount of waste (S205).

In S205, the count of the ordinary printing counter acquired in S101 is multiplied by a coefficient k, the count of the registration-error-correction printing counter acquired in S101 is multiplied by a coefficient p, and the count of the density-correction printing counter acquired in S101 is multiplied by a coefficient q. The resultant three products are added together. The sum, namely, (the number of ordinary printing operations×k)+(the number of registration-error-correction printing operations×p)+(the number of density-correction printing operations×q), is set as an estimated amount of waste.

It is noted that the coefficients k, p and q are preset constants. Coefficient k corresponds to the amount of waste that is generated in the operation of forming toner images in the ordinary printing process. Coefficient p corresponds to the amount of waste that is generated in the operation of forming toner images in the registration-error-correction printing operation. Coefficient q corresponds to the amount of waste that is generated in the operation of forming toner images in the density-correction printing operation. The coefficients k, p, and q have such values that are proportional to the amounts of waste generated in the corresponding printing operations. The values of the coefficients k, p, and q may not be exactly proportional to the amount of wastes generated in the corresponding printing operations. The values of the coefficients k, p, and q may have such values that are weighted so as to approximate the amounts of waste generated in the corresponding printing operations.

It is noted that the ordinary printing counter may be modified to count up or down the value of the coefficient k every time the ordinary printing operation is performed, that the registration-error-correction printing counter may be modified to count up or down the value of the coefficient p every time the registration-error-correction printing operation is performed, and that the density-correction printing counter may be modified to count up or down the value of the coefficient q every time the density-correction printing operation is performed. In this case, the estimated amount of waste can be determined merely by calculating the sum of the counts of the three counters. The apparatus 1 may further have an additional counter that holds the sum of the counts of the three counters. The estimated amount of waste can be obtained merely by reading the count of this counter.

It is noted that in the ordinary printing process, toner images are formed on one page's worth of recording medium. In the registration-error-correction printing process and the density-correction printing process, toner images are formed directly on the conveyor belt 15. Therefore, waste is generated in a larger amount during the registration-error-correction printing process and the density-correction printing process, than during the ordinary printing process. In view of this, coefficient k corresponding to the amount of waste generated in the ordinary printing is smaller than coefficients p and q corresponding to the amounts of waste generated in the registration-error-correction printing and the density-correction printing. Thus, k, p, and q satisfy the following relationship: $k<p, q$.

After calculating the estimated amount of waste in S205, the control unit 31 determines in S207 the waste-accumulation state of the waste box 19 based on the detected state acquired in S203 and on the estimated amount of waste calculated in S205 in accordance with the waste-accumulation state that has been determined latest.

Figure 8:
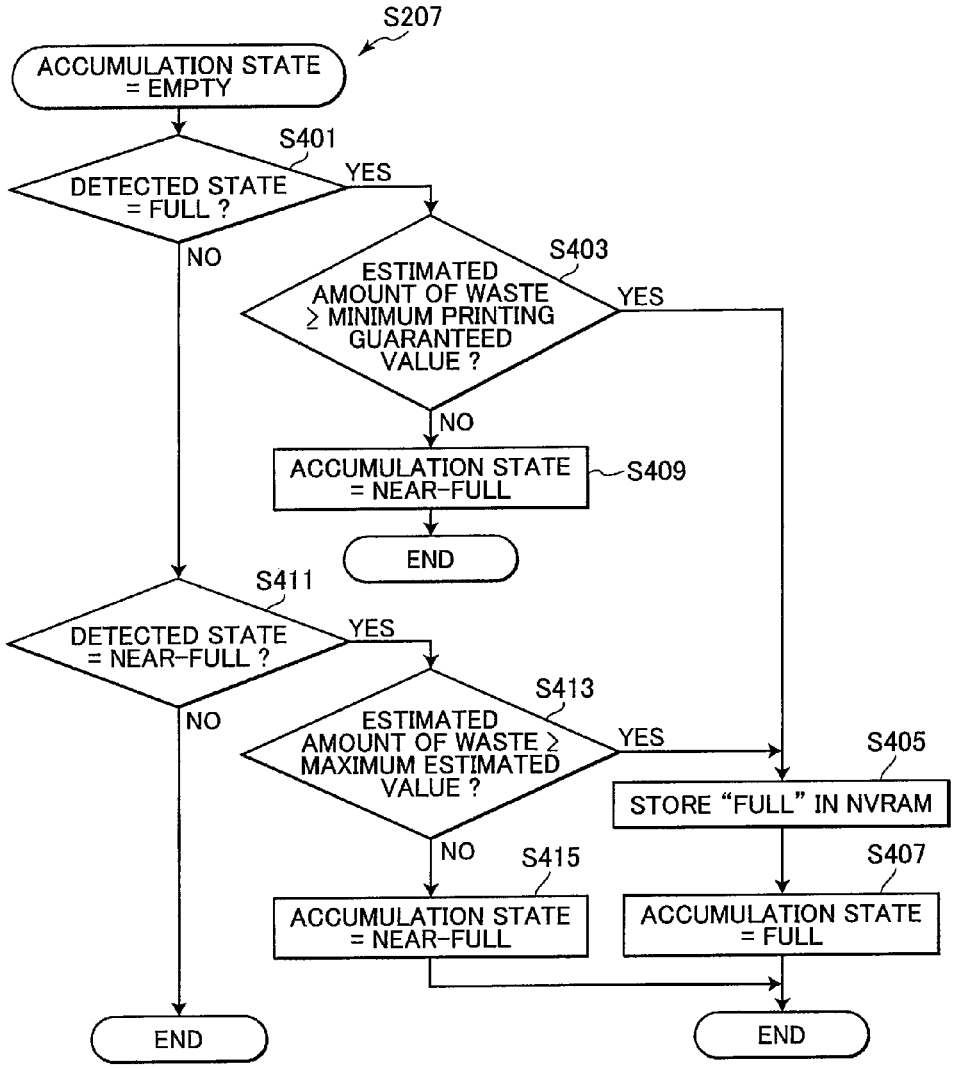
FIG. 8 is a flowchart showing the process of determining the state of the waste box when the box has been determined as empty.
Figure 9:
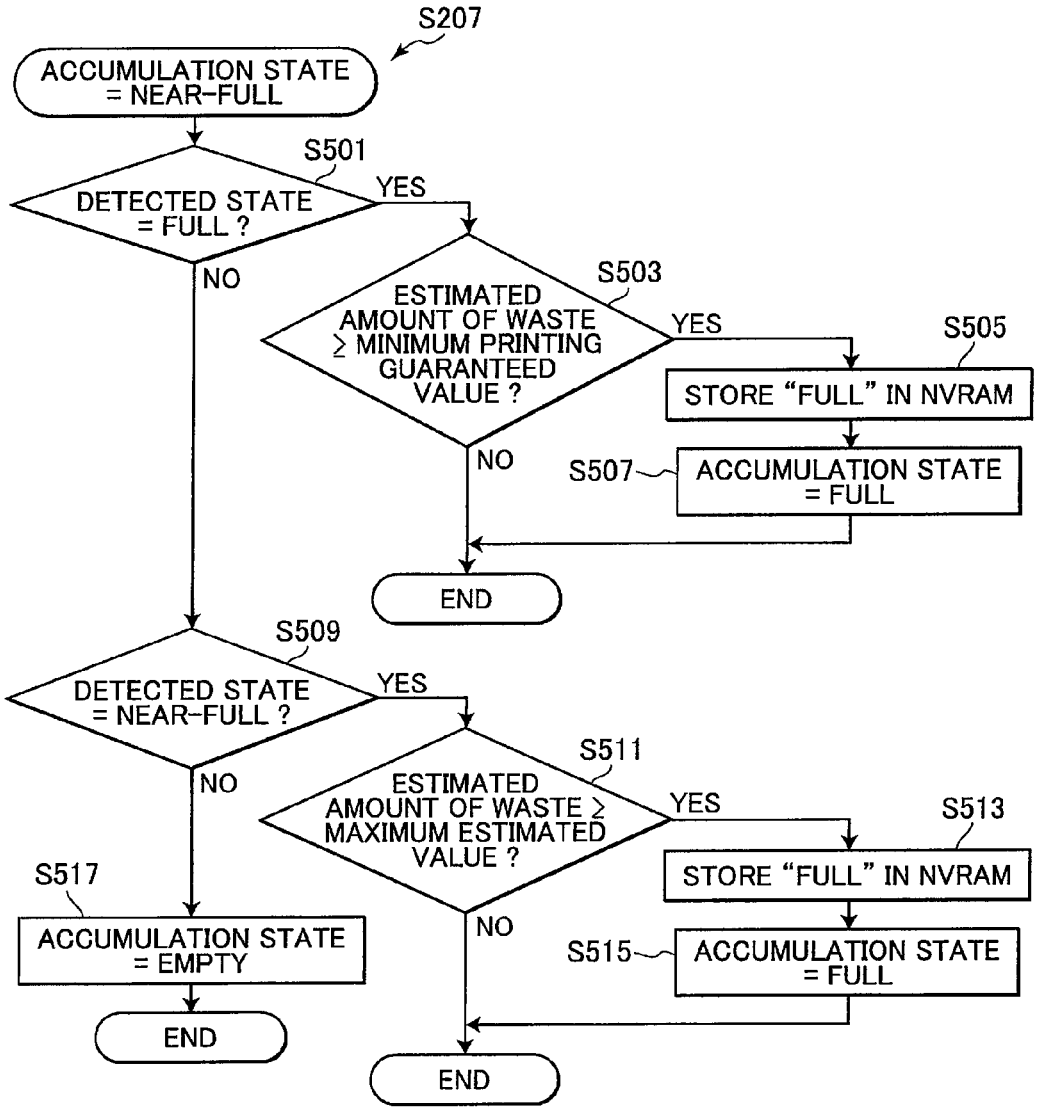
FIG. 9 is a flowchart showing the process of determining the state of the waste box when the box has been determined as nearly full.
Figure 10:
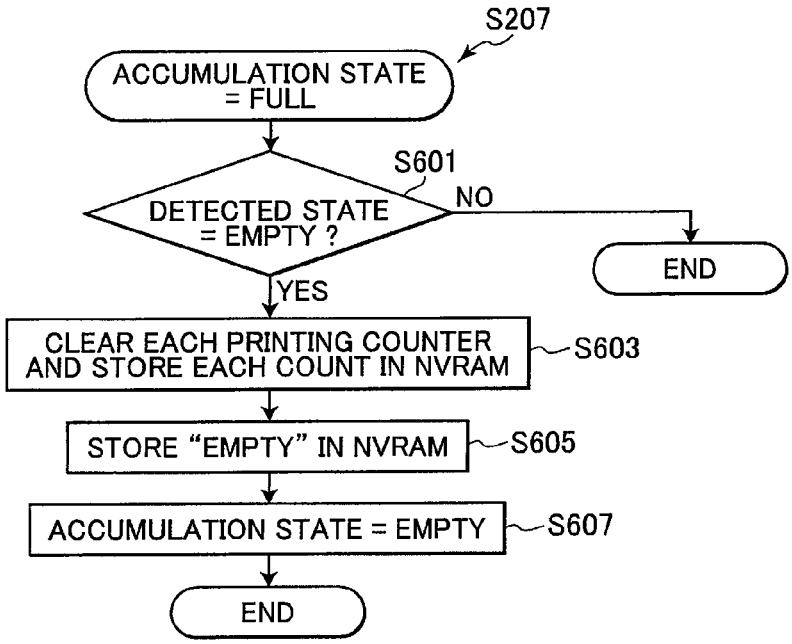
FIG. 10 is a flowchart showing the process of determining the state of the waste box when the box has been determined as full.

More specifically, in S207, one of three different processes shown in FIGS. 8, 9, and 10 is executed in accordance with the waste-accumulation state that has been determined latest. If no warming up process of FIG. 6 or no printing process of FIG. 11 (to be described later) is executed before the present warming up process, the waste-accumulation state that has been determined latest is the waste-accumulation state that has been acquired from the NVRAM in S103 (FIG. 5). If the present warming up process is executed after another warming up process has been executed, the waste-accumulation state that has been determined latest is the waste-accumulation state that has been determined in S207 of the latest-executed warming up process and that has been set in the RAM. If the present warming up process is executed after a printing process of FIG. 11 has been executed, the waste-accumulation state that has been determined latest is the waste-accumulation state that has been determined in S717 of the latest-executed printing process and that has been set in the RAM.

The process of FIG. 8 is executed in S207 if the latest-determined waste-accumulation state is "empty". The process of FIG. 9 is executed in S207 if the latest-determined waste-accumulation state is "near-full". The process of FIG. 10 is executed in S207 if the latest-determined waste-accumulation state is "full".

First will be described with reference to the flowchart of FIG. 8 how the process of S207 is executed if the latest-determined waste-accumulation state is "empty".

At the start of the process shown in FIG. 8, the control unit 31 determines whether the state set in S203 is "full" or not (S401). If the state set in S203 is "full" (YES in S401), the control unit 31 determines whether the estimated amount of waste determined in S205 is equal or larger than the minimum printing guaranteed value X (S403).

If the estimated amount of waste is equal to or larger than the minimum printing guaranteed value X (YES in S403), it is known that the waste box 19 is probably filled up with waste. Therefore, data indicative of "full state" is stored in the NVRAM (S405), and the waste-accumulation state is set to "full" and the waste-accumulation state "full" is stored in the RAM (S407). The process shown in FIG. 8 is then terminated. Thus, in S407, the waste-accumulation state is changed from "empty" to "full."

On the other hand, if the estimated amount of waste is smaller than the minimum printing guaranteed value X (NO in S403, it is known that both sensors #1 and #2 detect the waste, but the estimated amount of waste has not yet reached the minimum printing guaranteed value X. It is determined that the waste box 19 has room for waste, though both sensors #1 and #2 have detected the waste. So, the waste-accumulation state is set to "near-full" and the determined waste-accumulation state "near-full" is stored in the RAM (S409). Then, the process shown in FIG. 8 is terminated. Thus, in S409, the waste-accumulation state is changed from "empty" to "near-full."

On the other hand, if the detected state set in S203 is not "full" (no in S401), the control unit 31 determines whether the detected state set in S203 is "near-full" (S411). If the detected state set in S203 is "near-full" (YES in S411), the control unit 31 determines whether the estimated amount of waste is equal to or larger than the maximum estimated value Y (S413).

If the estimated amount of waste is equal to or larger than the maximum estimated value Y (YES in S413), it is known that the waste box 19 is probably filled up. Therefore, data indicative of "full state" is stored in the NVRAM (S405), and the waste-accumulation state is set to "full" and the determined waste-accumulation state "full" is stored in the RAM (S407). The process shown in FIG. 8 is then terminated. Thus, in S407, the waste-accumulation state is changed from "empty" to "full."

On the other hand, if the estimated amount of waste is smaller than the maximum estimated value Y (NO in S413), it is known that the estimated amount of waste has not yet reached the maximum estimated value Y and either one of the sensors #1 and sensor #2 has not yet detected waste.

It is estimated that the waste box 19 has room for waste. So, the waste-accumulation state is set to "near-full" and the determined waste-accumulation state "near-full" is stored in the RAM (S415). Then, the process shown in FIG. 8 is terminated. Thus, in S415, the waste-accumulation state is changed from "empty" to "near-full."

If the detected state set in S203 is not "near-full (NO in S411, the process shown in FIG. 8 is terminated. As a result, the waste-accumulation state is maintained as unchanged from "empty".

Next will be described with reference to the flowchart of FIG. 9 how the process of S207 is executed if the latest-determined waste-accumulation state is "near-full".

At the start of the process shown in FIG. 9, the control unit 31 determines whether the state set in S203 is "full" or not (S501). If the state set in S203 is "full" (YES in S501), the control unit 31 determines whether the estimated amount of waste determined in S205 is equal or larger than the minimum printing guaranteed value X (S503).

If the estimated amount of waste is equal to or larger than the minimum printing guaranteed value X (YES in S503), it is known that the waste box 19 is probably filled up with waste. Therefore, data indicative of "full state" is stored in the NVRAM (S505), and the waste-accumulation state is set to "full" and the waste-accumulation state "full" is stored in the RAM (S507). The process shown in FIG. 9 is then terminated. Thus, in S507, the waste-accumulation state is changed from "near-full" to "full."

On the other hand, if the estimated amount of waste is smaller than the minimum printing guaranteed value X (NO in S503), it is known that both sensors #1 and #2 detect the waste, but the estimated amount of waste has not yet reached the minimum printing guaranteed value X. It is determined that the waste box 19 has room for waste, though both sensors #1 and #2 have detected the waste. So, the process shown in FIG. 9 is terminated. As a result, the waste-accumulation state is maintained as unchanged from "near-full".

On the other hand, if the detected state set in S203 is not "full" (no in S501), the control unit 31 determines whether the detected state set in S203 is "near-full" (S509). If the detected state set in S203 is "near-full" (YES in S509), the control unit 31 determines whether the estimated amount of waste is equal to or larger than the maximum estimated value Y (S511).

If the estimated amount of waste is equal to or larger than the maximum estimated value Y (YES in S511), it is known that the waste box 19 is probably filled up. Therefore, data indicative of "full state" is stored in the NVRAM (S513), and the waste-accumulation state is set to "full" and the determined waste-accumulation state "full" is stored in the RAM (S515). The process shown in FIG. 9 is then terminated. Thus, in S515, the waste-accumulation state is changed from "near-full" to "full."

On the other hand, if the estimated amount of waste is smaller than the maximum estimated value Y (NO in S511), it is known that the estimated amount of waste has not yet reached the maximum estimated value Y and either one of the sensors #1 and sensor #2 has not yet detected waste. So, it is estimated that the waste box 19 has room for waste. The process shown in FIG. 9 is terminated. As a result, the waste-accumulation state is maintained as unchanged from "near-full".

If the detected state set in S203 is not "near-full (NO in S509, the waste-accumulation state is set to "empty" and the determined waste-accumulation state "empty" is stored in the RAM (S517). Then, the process shown in FIG. 9 is terminated. Thus, in S517, the waste-accumulation state is changed from "near-full" to "empty."

Next will be described with reference to the flowchart of FIG. 10 how the process of S207 is executed if the latest-determined waste-accumulation state is "full".

When the process shown in FIG. 10 is started, the control unit 31 determines whether the detected state set in S203 is "empty" or not (S601). If the detected state is "empty" (YES in S601), it is estimated that the waste box 19 has been replaced with new one. Therefore, the control unit 31 clears all of the ordinary printing counter, the registration-error-correction printing counter, and the density-correction printing counter, and stores the counts of the counters in the NVRAM (S603). In other words, the control unit 31 resets to zero (0) the count values of all the ordinary printing counter, the registration-error-correction printing counter, and the density-correction printing counter, and stores the count values of zero (0) in the NVRAM (S603).

Then, data indicative of "empty" is stored in the NVRAM (S605), and the waste-accumulation state is set to "empty" and the waste-accumulation state "empty" is stored in the RAM (S607). The process shown in FIG. 10 is then terminated. Thus, in S607, the waste-accumulation state is changed from "full" to "empty."

If the detected state set in S203 is not "empty" (NO in S601), the process shown in FIG. 10 is terminated. As a result, the waste-accumulation state is maintained as unchanged from "full".

In this way, either one of the processes of FIGS. 8 to 10 is executed to determine the current waste-accumulation state in accordance with the latest-determined waste-accumulation state.

As shown in FIG. 6, after determining the current waste-accumulation state in S207, the control unit 31 determines whether the current waste-accumulation state is "full" (S209).

If the current waste-accumulation state is "full" (YES in S209), the control unit 31 controls the operation panel 33 to display a message informing a user that the box 19 is full of waste (S211). The control unit 31 performs an error process prohibiting the image forming unit 5 from forming toner images (S213). Then, the warming-up process of FIG. 6 is terminated.

In this way, the image forming apparatus 1 informs the user that the box 19 is full of waste during the warming-up process. The image forming apparatus 1 is disabled to perform the function of forming toner images thereafter.

On the other hand, if the current waste-accumulation state is not "full" (NO in S209), the control unit 31 determines whether the current waste-accumulation state is "near-full" or not (S216).

If the current waste-accumulation state is "near-full" (YES in S215), the control unit 31 controls the operation panel 33 to display a message informing a user that the box 19 is nearly full of waste (S217). The control unit 31 enables the image forming unit 5 to form toner images (S219). Then, the warming-up process of FIG. 6 is terminated.

In this way, the image forming apparatus 1 informs the user that the box 19 is nearly full of waste during the warming-up process. The image forming apparatus 1 is enabled to perform the function of forming toner images thereafter.

On the other hand, if the current waste-accumulation state is not "near-full", that is, if the current waste-accumulation state is "empty" (NO in S215), the control unit 31 permits the image forming unit 5 to form toner images (S219). The process shown in FIG. 6 is then terminated. Thus, when the current waste-accumulation state is "empty", the image forming apparatus 1 does not inform the user of the waste-accumulation state. The image forming apparatus 1 is able to use the function of forming toner images.

Accordingly, after the waste-accumulation state becomes full and the image forming unit 5 is disabled to form toner images, if the toner box 19 is replaced with a new one and both of the detection sensors 23 and 24 become detecting no waste, the control unit 31 enables the image forming unit 5 back to the state capable of forming toner images.

Figure 11:
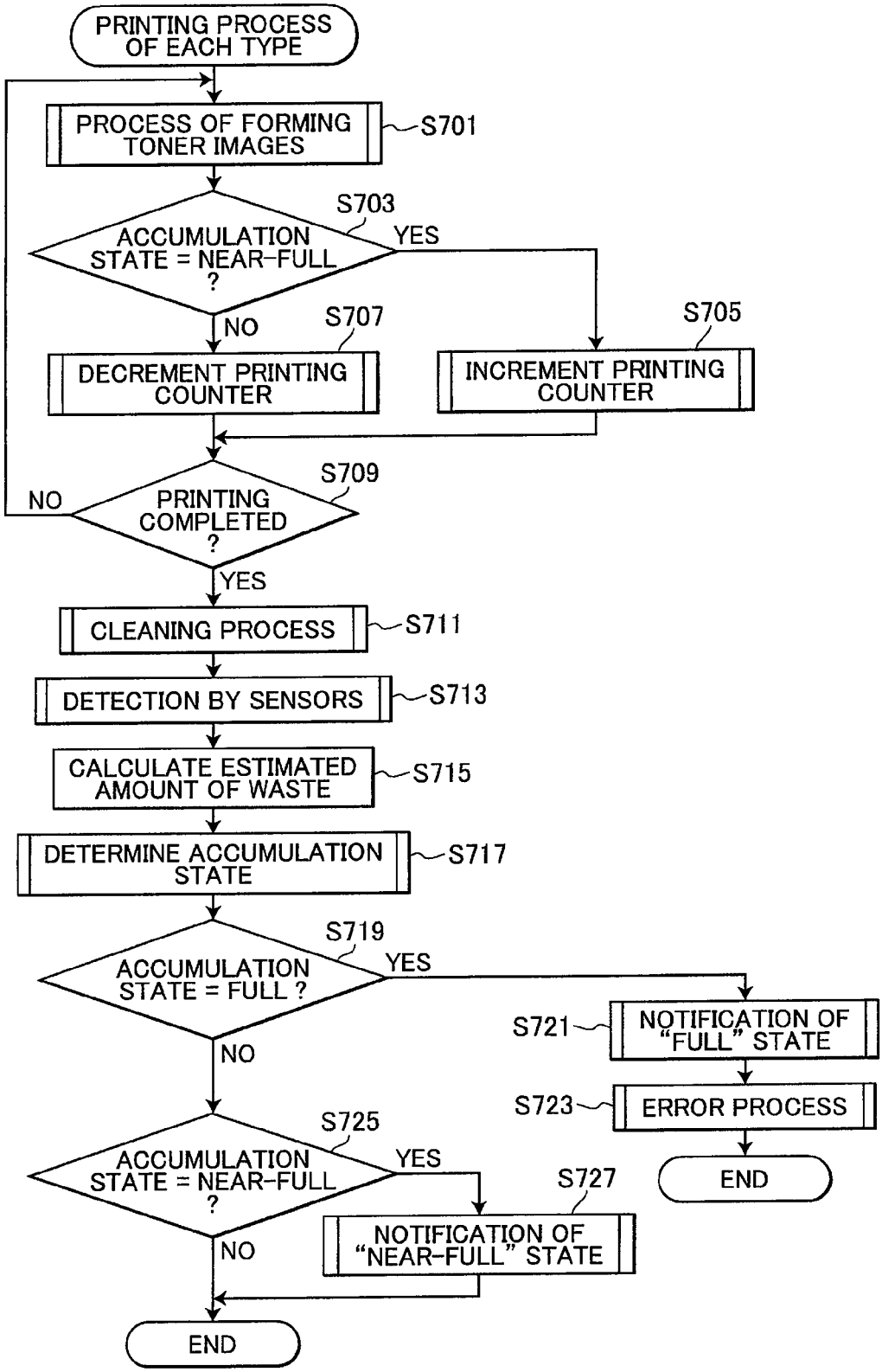
FIG. 11 is a flowchart showing the printing process of each type.

A printing process of each type (each of the ordinary printing, the registration-error-correction printing, and the density-correction printing) is executed as shown in FIG. 11.

This printing process is performed when a corresponding input (data to be printed, a registration-error-correction instruction, or a density-correction instruction) is supplied to the image forming apparatus 1 and when the image forming unit 5 is in a state capable of performing toner image forming operation. Thus, the printing process cannot be executed if the image forming unit 5 has been disabled as a result of the error process of S213 of FIG. 6 or S723 (to be described later).

When the printing process is started, the control unit 31 first controls the image forming unit 5 to form toner images (S701). More specifically, if the printing process is the ordinary printing, the image forming unit forms toner images on recording medium for one page. If the printing is the registration-error-correction printing or density-correction printing, the image forming unit 5 forms toner images directly on the conveyor belt 15.

After performing S701, the control unit 31 determines whether the latest-determined waste-accumulation state is "near-full" or not (S703). The latest-determined waste-accumulation state may be the waste-accumulation state that has been determined in S207 in the warming process that has been executed immediately before the current printing process. The latest-determined waste-accumulation state may also be the waste-accumulation state that has been determined in S717 in another printing process that has been executed before the current printing process.

If the latest-determined waste-accumulation state is "near-full" (YES in S703), the count of a printing counter corresponding to the type of the present printing process is incremented by one (S705). That is, if the present printing process is the ordinary printing, the count of the ordinary printing counter is incremented by one. If the present printing process is the registration-error-correction printing, the count of the registration-error-correction printing counter is incremented by one. If the present printing process is the density-correction printing, the count of the density-correction printing counter is incremented by one.

Figure 12:
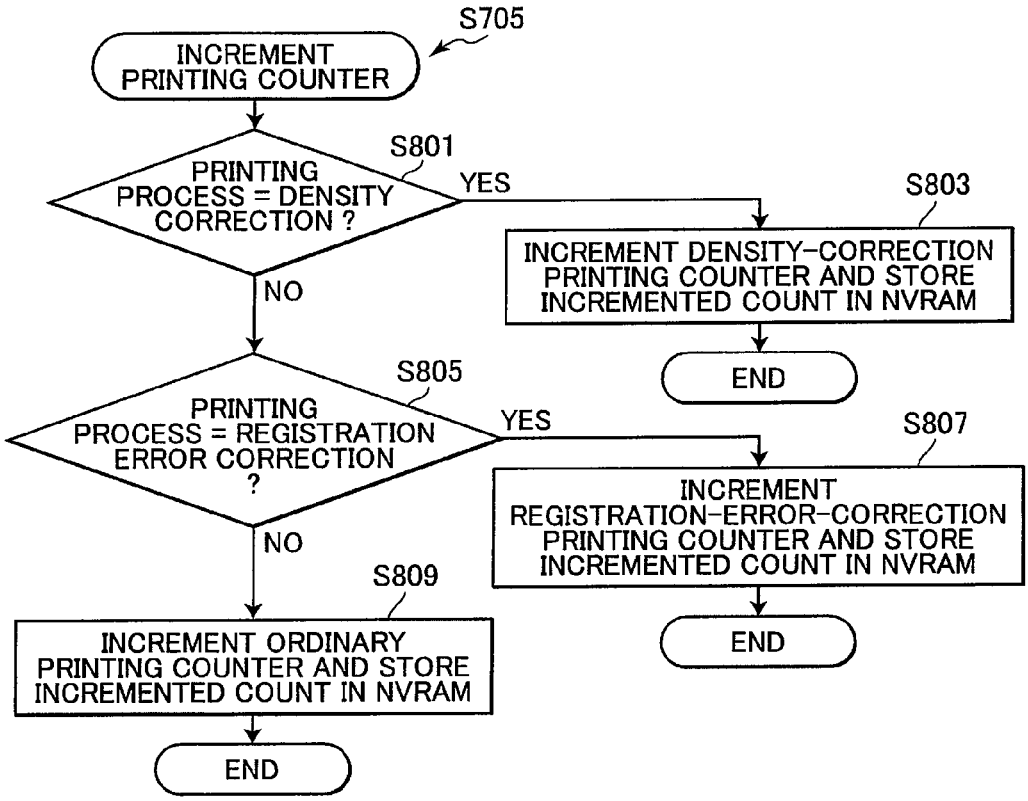
FIG. 12 is a flowchart showing the process of incrementing a printing counter.

The process of S705 will be explained below in detail with reference to FIG. 12.

In the process of S705 (FIG. 12) of incrementing the printing counter, the control unit 31 first determines whether the printing process is the density-correction printing (S801). If the printing process is the density-correction printing (YES in S801), the control unit 31 increments the count of the density-correction printing counter by one and stores the counted result of this counter into the NVRAM (S803). Then, the process of S705 is terminated.

On the other hand, if the printing process is not the density-correction printing (NO in S801), the control unit 31 determines whether the printing process is the registration-error-correction printing (S805). If the printing process is the registration-error-correction printing (YES in S805), the operation goes to S807.

In S807, the control unit 31 increments by one the count of the registration-error-correction printing counter and stores the counted result of this counter into the NVRAM. Then, the process of S705 is terminated.

If the printing process is not the registration-error-correction printing (NO in S805), the control unit 31 increments by one the count of the ordinary printing counter and stores the counted result of this counter into the NVRAM (S809). Then, the process of S705 is terminated.

On the other hand, if the latest-determined waste-accumulation state is not "near-full" (NO in S703), this means that the latest-determined waste-accumulation state is "empty" and therefore that no waste sensors have detected waste. The waste sensors 23 and 24 may possibly have continued detecting no waste, or some waste sensor 23 or 24 may possibly have changed from the state of detecting waste back to the state of detecting no waste. In such cases, the process of S703 becomes negative (no in S703).

If the latest-determined waste-accumulation state is not "near-full" (NO in S703), the control unit 31 decrements by one a printing counter that corresponds to the type of the present printing process (S707). It is noted that the count value of the printing counter of each type may not be decremented to a value lower than the value of zero (0). After the count value of the printing counter of each type reaches zero (0), the count value will continue being zero (0) when the count value is decremented.

Figure 13:
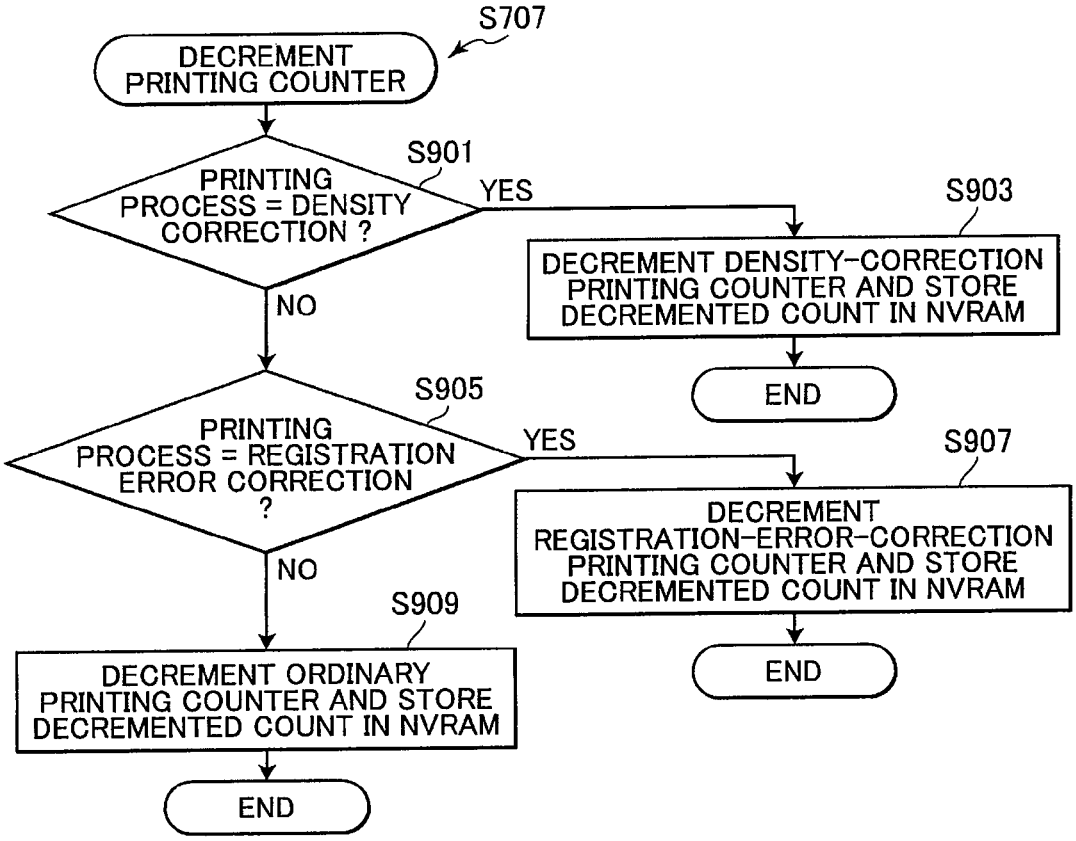
FIG. 13 is a flowchart showing the process of decrementing the printing counter.

The process of S707 will be explained below in detail with reference to FIG. 13.

In the process of S707 (FIG. 13) of decrementing the printing counter, the control unit 31 first determines whether the printing process is the density-correction printing (S901). If the printing process is the density-correction printing (YES in S901), the control unit 31 decrements the count of the density-correction printing counter by one and stores the counted result of this counter into the NVRAM (S903). Then, the process of S707 is terminated.

On the other hand, if the printing process is not the density-correction printing (NO in S901), the control unit 31 determines whether the printing process is the registration-error-correction printing (S905). If the printing process is the registration-error-correction printing (YES in S905), the operation goes to S907.

In S907, the control unit 31 decrements by one the count of the registration-error-correction printing counter and stores the counted result of this counter into the NVRAM. Then, the process of S707 is terminated.

If the printing process is not the registration-error-correction printing (NO in S905), the control unit 31 decrements by one the count of the ordinary printing counter and stores the counted result of this counter into the NVRAM (S909). Then, the process of S707 is terminated.

After performing S705 or S707, the control unit 31 determines whether the printing has been completed or not (S709). That is, the control unit 31 determines whether the image forming unit 5 has finished performing the corresponding printing process (toner image forming process).

More specifically, if a plurality of pages' worth of data is received for the ordinary printing, the decision is made affirmative in S709 if data of all the pages has been printed, and the decision is made negative in S709 if data of any page has not yet been printed. For the registration-error-correction printing or the density-correction printing, if the registration-error-correction printing or the density-correction printing has been completed, the decision is made affirmative in S709.

If printing has not been completed (NO in S709), the process returns to S701. The processes of S701 and the subsequent processes are then repeated.

If printing has been completed (YES in S709), the cleaning process is performed (S711) in the same manner as in S201 (FIG. 6).

The control unit 31 then controls the waste sensors 23 and 24 and sets the detected state (S713) in the same manner as S203 that is described above with reference to FIG. 7.

After performing S713, the control unit 31 calculates the estimated amount of waste recovered in the waste box 19 (S715) in the same manner as in S205. That is, in S715, the count of the ordinary printing counter is acquired from the NVRAM and is multiplied by the coefficient k, the count of the registration-error-correction printing counter is acquired from the NVRAM and is multiplied by the coefficient p, and the count of the density-correction printing counter is acquired from the NVRAM and is multiplied by the coefficient q. The resultant three products are added together. The sum, namely, (the number of ordinary printing operations×k)+(the number of registration-error-correction printing operations×p)+(the number of density-correction printing operations×q), is set as the estimated amount of waste.

After calculating the estimated amount of waste, the control unit 31 determines the current waste-accumulating state of the waste box 19 (S717). In S717, the waste-accumulating state is determined in the same manner as in S207. In other words, in S717, the control unit 31 performs the process of FIG. 8, 9, or 10 in accordance with the latest-determined waste-accumulation state and based on the detected state set in S713 and on the estimated waste amount calculated in S715.

After performing the process of S717, the control unit 31 determines whether the current waste-accumulation state that is determined in S717 is "full" (S719).

If the current waste-accumulation state is "full" (YES in S719), the control unit 31 controls the operation panel 33 to display a message, informing the user that the waste box 19 is full of waste (S721). The control unit 31 then performs an error process, prohibiting the image forming unit 5 from forming toner images (S273). Then, the corresponding printing processes is terminated.

In this way, the image forming apparatus 1 informs the user that the waste box 19 is full, and is brought into a state not being able to use the function of forming toner images.

On the other hand, if the current waste-accumulation state is not "full" (NO in S719), the control unit 31 determines whether the current waste-accumulation state that is determined in S717 is "near-full" (S725).

If the current waste-accumulation state is "near-full" (YES in S725), the control unit 31 controls the operation panel 33 to display a message, informing the user that the waste box 19 is nearly filled with waste (S727). Then, the corresponding printing process is terminated.

In this way, the image forming apparatus 1 informs the user that the waste box 19 is "near-full" when the waste box 19 is "near-full" during the printing processes. The image forming apparatus 1 remains able to use the function of forming toner images.

On the other hand, if the current waste-accumulation state is not "near-full" (NO in S725), the process of FIG. 11 is terminated. In this case, the image forming apparatus 1 does not inform the user of the waste-accumulation state and remains able to use the function of forming toner images.

As described above, according to the image forming apparatus 1, the control unit 31 uses one of the counters that corresponds to the type of the presently-being executed printing process to start counting up when at least one of the sensors 23 and 24 detects waste, thereby starting incrementing the estimated waste amount. The waste box 19 is not determined to be filled up if the estimated amount of waste has not reached the minimum printing guaranteed value X, even if the two waste sensors 23 and 24 detect the waste.

Additionally, the waste box 19 is not determined to be filled up while one of the waste sensors 23 and 24 does not detect waste, even though the estimated amount of waste has reached the minimum printing guaranteed value X.

Hence, the image forming apparatus 1 can determine that the waste box 19 is filled up with waste at a more appropriate timing than a comparative image forming apparatus that determines whether the box is filled up with waste by using two sensors only or by using count values of the counters only. The image forming apparatus 1 can prolong the lifetime of the waste box 19.

According to the present embodiment, when the estimated amount of waste becomes equal to or larger than the maximum estimated value Y, it is determined that the amount of waste recovered in the waste box 19 has reached the maximum amount, in other words, that the waste-accumulation state becomes "full", even if one of the waste sensors 23 and 24 has not yet detected waste. Hence, the image forming apparatus 1 can reliably determine that the waste box 19 is filled up, even if one of the two waste sensors 23 and 24 fails to detect waste.

In the image forming apparatus 1, values corresponding to the ordinary printing, registration-error-correction printing and the density-correction printing are added to the estimated amount of waste recovered, thereby incrementing the estimated amount of waste recovered. Thus, the estimated amount of waste reflects the amounts of waste generated in the ordinary printing, the registration-error-correction printing and the density-correction printing.

When one of the two waste sensors 23 and 24 first detects waste and then ceases to detect waste, the values corresponding to the ordinary printing, registration-error-correction printing and the density-correction printing are subtracted from the estimated amount of waste, thus decrementing the estimated amount of waste.

If the count-down due to the subtraction continues for a short period of time, it is estimated that the sensor is normally or correctly detecting waste. The count value decreases a little and then increases again. Hence, the image forming device 1 can determine that the waste box 19 is filled up at an appropriate timing without an excessive delay.

If the count-down continues for a long period of time, it is estimated that the sensor normally or correctly detects no waste. The count value decreases, canceling out the initially-executed temporal count-up. Hence, the image forming device 1 can determine that the waste box 19 is filled up at an appropriate timing with a sufficiently long delay.

After at least one of the two waste sensors 23 and 24 has detected waste, if all of the at least one of the two waste sensors 23 and 24 that has detected waste ceases to detect the waste due to the replacement of the waste box 19 with a new one, the count-down is started and is performed several times. As a result, the count value is returned to the initial value, that is, zero (0).

Hence, the count value may not be reset when the waste box 19 is replaced. That is, S603 may be omitted.

The waste box 19 is removably provided in the housing of the image forming apparatus 1. As the waste box 19 is inserted into and pulled from the housing, the detecting states of the waste sensors 23 and 24 may possibly change. The count value is corrected in accordance with this change. This prevents the waste-accumulation state from being determined inappropriately due to the results from the count value that has been obtained before the change of the detecting state.

In addition, the cleaning mechanism 21 is independent of the conveyor belt 15. The cleaning mechanism 21 can be replaced with a new one together with the waste box 18. Hence, the user can replace the cleaning mechanism 21, together with the waste box 19, when he or she is advised to replace the waste box 19 with a new one by the message that is displayed on the operation panel 33 in accordance with the detecting states of the waste sensors 23 and 24 and the estimated amount of waste. Thus, the user is prompted to replace the cleaning mechanism 21 on the basis of the amount of waste in the waste box 19.

The waste box 19 is so designed that the length of the lifetime of the cleaning mechanism 21 is almost equal to the length of time from which the waste box 19 is replaced with a new one until the waste box 19 is filled up with waste. Hence, the cleaning mechanism 21 can be replaced with a new one simultaneously when the waste box 19 should be replaced with a new one. The cleaning mechanism 21 and the waste box 19 can be replaced with new ones with high efficiency.

While the invention has been described in detail with reference to the embodiment thereof, it would be apparent to those skilled in the art that various changes and modifications may be made therein without departing from the spirit of the invention.

For example, in the above-described embodiment, the image forming apparatus 1 has the image forming unit 5 that can print multicolor images. However, the image forming unit 5 may be modified to print monochrome images only. In such a case, the registration-error-correction need not be performed.

In the embodiment described above, the number of printings is counted for each of the ordinary printing, the registration-error-correction printing and the density-correction printing. However, the number of printings may be counted for any other processes that involve toner-image forming operations. The counted results may be reflected to determination of the estimated waste amount.

The error message displayed in S217, S727 may indicate that the cleaning mechanism 21 should soon be replaced by a new one. The error message displayed in S211, S721 may indicate that the cleaning mechanism 21 should be replaced with a new one immediately.

It is noted that according to the embodiment, while no sensors 23 and 24 detect waste, the waste-accumulation state is "empty". When at least one of the waste sensors 23 and 24 detects waste, the waste-accumulation state becomes "near-full". So, the error message displayed in S211, S721 may indicate that at least one of the sensors has detected waste. The waste-accumulation state of "full" indicates that the waste box 19 is full of waste, that is, the waste accumulated in the waste box 19 reaches the maximum amount that the waste box 19 can store therein.

In the above-described embodiment, the waste sensors 23 and 24 are mounted inside the waste box 19. However, the waste sensors 23 and 24 may be mounted inside the image forming apparatus 1 at a location outside the waste box 19. The waste box 19 is provided with a window part through which light can pass. The waste sensors 23 and 24 can detect waste accumulated inside the waste box 19 by emitting light into the window part.

What is claimed is:

1. An image forming apparatus comprising:

an image forming unit that is configured to form a toner image;

a containing unit that is configured to contain waste that is generated when the image forming unit forms a toner image;

two detecting units that are configured to detect the waste accumulated in the containing unit;

a counting unit that starts, when at least one of the two detecting units detects waste, counting up a count value based on the toner image forming operation executed by the image forming unit; and a determining unit that determines that waste accumulated in the containing unit has reached a maximum amount if the count value of the counting unit is equal to or greater than a predetermined first threshold value and both of the two detecting units detects waste.

2. The image forming apparatus according to claim 1, wherein the determining unit determines that waste accumulated in the containing unit has reached the maximum amount also if the count value of the counting unit becomes equal to or greater than a second threshold value greater than the first threshold value.

3. The image forming apparatus according to claim 1, wherein the image forming unit is configured so as to be able to perform a printing for forming an image on a recording medium, and the counting unit adds a first value to the count value every time the image forming unit performs the printing.

4. The image forming apparatus according to claim 1, wherein the image forming unit is configured so as to be able to perform a registration-error-correction printing for forming a toner image, and the counting unit adds a second value to the count value every time the image forming unit performs the registration-error-correction printing.

5. The image forming apparatus according to claim 1, wherein the image forming unit is configured so as to be able to perform a density-correction printing for forming a toner image, and the counting unit adds a third value to the count value every time the image forming unit performs the density-correction printing.

6. The image forming apparatus according to claim 1, wherein the counting unit starts counting down the count value if all of at least one detecting unit that has detected waste stops detecting waste.

7. The image forming apparatus according to claim 6, wherein the image forming unit is configured so as to be able to perform a printing for forming an image on a recording medium, and wherein if all of at least one detecting unit that has detected waste stops detecting waste, the counting unit subtracts a first value from the count value every time the image forming unit performs the printing.

8. The image forming apparatus according to claim 6, wherein the image forming unit is configured so as to be able to perform a registration-error-correction printing for forming a toner image, and wherein if all of at least one detecting unit that has detected waste stops detecting waste, the counting unit subtracts a second value from the count value every time the image forming unit performs the registration-error-correction printing.

9. The image forming apparatus according to claim 6, wherein the image forming unit is configured so as to be able to perform a density-correction printing for forming a toner image, and wherein if all of at least one detecting unit that has detected waste stops detecting waste, the counting unit subtracts a third value from the count value every time the image forming unit performs the density-correction printing.

10. The image forming apparatus according to claim 1, further comprising a notifying unit that notifies that at least one of the two detecting units has detected waste when at least one of the two detecting units detects waste.

11. The image forming apparatus according to claim 1, further comprising a prohibiting unit that prohibits the image forming unit from forming toner images when the determining unit determines that the amount of waste accumulated in the containing unit has reached the maximum amount.

12. The image forming apparatus according to claim 11, further comprising a disabling unit that disables the prohibiting unit when both of the two detecting units become detecting no waste.

13. The image forming apparatus according to claim 1, further comprising a housing, the containing unit being removably mounted in the housing.

14. An image forming apparatus comprising:

an image forming unit that is configured to form a toner image;

a containing unit that is configured to contain waste that is generated when the image forming unit forms a toner image;

first and second detecting units that are configured to detect the waste accumulated in the containing unit;

a counting unit that starts, when the first detecting unit detects waste, counting up a count value based on the toner image forming operation executed by the image forming unit; and a determining unit that determines that waste accumulated in the containing unit has reached a maximum amount if the count of the counting unit is equal to or greater than a predetermined first threshold value and the second detecting unit detects waste.

15. The image forming apparatus according to claim 14, wherein the determining unit determines that waste accumulated in the containing unit has reached the maximum amount also if the counted value of the counting unit becomes equal to or greater than a second threshold value greater than the first threshold value regardless of whether or not the second detecting unit detects waste.

* * * * *